US007320411B1

(12) United States Patent
Shenosky et al.

(10) Patent No.: US 7,320,411 B1
(45) Date of Patent: Jan. 22, 2008

(54) SELECTIVELY SEALABLE CONTAINER LINER

(76) Inventors: Patricia L. Shenosky, 4400 Idlebrook Dr., Akron, OH (US) 44333; Theodore E Shenosky, 4400 Idlebrook Dr., Akron, OH (US) 44333

( * ) Notice: Subject to any disclaimer, the term of this patent is extended or adjusted under 35 U.S.C. 154(b) by 525 days.

(21) Appl. No.: 10/657,448

(22) Filed: Sep. 8, 2003

(51) Int. Cl.
*B65D 25/14* (2006.01)
*B65D 35/14* (2006.01)
*B65D 90/00* (2006.01)

(52) U.S. Cl. ..... 220/495.06; 383/98

(58) Field of Classification Search ..... 383/76, 383/71, 98, 72, 78, 84, 86.1, 86.2, 99; 220/495.11, 220/495.01, 495.03, 495.06
See application file for complete search history.

(56) References Cited

U.S. PATENT DOCUMENTS 1,318,974 A * 10/1919 Crews ..... 383/61.4
1,587,891 A * 6/1926 Berkowitz ..... 150/103
1,588,695 A * 6/1926 Boehm ..... 383/71
2,023,457 A * 12/1935 White ..... 24/114.7
2,068,058 A * 1/1937 Lewis ..... 150/113
2,431,030 A * 11/1947 Edwards ..... 383/6
2,656,093 A * 10/1953 Smith ..... 383/8
2,705,103 A * 3/1955 Carlile ..... 383/94
4,192,365 A * 3/1980 Siegel ..... 150/111
4,436,244 A * 3/1984 Morris ..... 229/117.12
4,596,040 A * 6/1986 LaFleur et al. ..... 383/7
4,988,216 A * 1/1991 Lyman ..... 383/74
5,097,979 A 3/1992 McDermott et al.
5,181,627 A 1/1993 McDermott et al.
5,240,134 A 8/1993 McDermott et al.
5,310,077 A 5/1994 McDermott et al.
D358,937 S 6/1995 Duckworth
5,725,039 A * 3/1998 Macinai et al. ..... 150/104
5,941,408 A 8/1999 Sherman
D445,254 S 7/2001 Jasper et al.
D445,255 S 7/2001 Rine et al.
D448,169 S 9/2001 Rine et al.
6,296,138 B1 10/2001 Hannah et al.

* cited by examiner

*Primary Examiner*—Anthony D. Stashick
*Assistant Examiner*—Harry A Grosso
(74) *Attorney, Agent, or Firm*—Eschweiler & Associates, LLC

(57) ABSTRACT

A reversible sack that is suitable for use as a container liner is disclosed. The sack is selectively sealable and in one example can be opened and/or closed to varying degrees. More particularly, the sack has an open end and one or more mechanisms associated therewith that facilitate opening and/or closing the open end of the sack. In one example, the sack also includes a mechanism that facilitates maintaining the open end of the sack in any of the various degrees of opened and/or closed conditions. The sack functions the same regardless of whether it is in a reversed or un-reversed configuration. The reversibility of the sack provides for added versatility and allows a user to employ the sack in an un-reversed and reversed configuration as may be desired and appropriate given particular settings, surroundings, times, seasons, etc.

19 Claims, 5 Drawing Sheets

SELECTIVELY SEALABLE CONTAINER LINER

FIELD OF INVENTION

The present invention relates generally to the field of containers, and more particularly to a sack that is selectively sealable and is suitable for use as a container liner.

BACKGROUND OF THE INVENTION

Many different types and styles of containers exist for a variety of different purposes and uses. Some containers may have somewhat rigid liners included therein that are generally designed to protect the containers, thereby potentially prolonging the life of the containers. By way of example, FIG. 1 illustrates a basket type container 100 suitable for use as a purse and/or decorative element. The container 100 may, for example, be predominantly fashioned out of one or more materials (e.g., thin strips of wood 102) that may be woven together. Such a container may, for example, be utilized to hold a bouquet of artificial flowers and/or other decorative aspects. This and similar types of containers can likewise be utilized around the house and/or in other suitable locals as a mail collection basin, repository for kitchen utensils (e.g., spatulas, dippers, etc.), pen and pencil holder, notepad, napkin and/or tissue holder, etc.

The container 100 depicted in FIG. 1 includes a liner 110 generally formed out of a relatively durable yet resilient material that affords some protection to mainly the interior of the container (e.g., from knife points, pen and pencil markings, debris and discoloration, etc.). The liner 110 may, for example, be formed out of plastic and/or other poly-based material(s) that may be contoured to the interior of the container 100. Such a plastic liner 110 may, however, not be very aesthetically pleasing or flattering to a woven basket type container such as that depicted in FIG. 1. The plastic liner 110 may also not be very soft or pleasant to the touch, and thus may not be a good compliment to such a container 100. Additionally, the rigid liner 110 is not closable or sealable. Accordingly, items may fall out of the basket type container 100 should it be tipped over or otherwise jostled about.

While some basket type containers can accommodate some types of lids, such lids are separate items that are not integral with the liner. Thus, they generally have an additional associated cost, which can be substantial, particularly when dealing with brand-name, collectible basket type containers, such as may be represented by the basket type container 100 depicted in FIG. 1. Moreover, such lids may do a poor job of maintaining items within the basket as they do not snugly engage an open end of the container. For example, FIG. 2 illustrates a basket type container 200 suitable for use as a mail receptacle, note pad holder, etc. having a (wooden) lid 202 that covers the container. However, the lid 202 is not fastened to the container 200, but merely rests thereon. As such, the lid 202 may easily become dislodged should the container 200 be upset. In this manner, contents 204 (e.g., notebooks, notepads, pens, pencils, etc.) of the container 200 can readily spill out, in addition to the lid 202 itself falling off.

Thus, a soft versatile container liner that may assist in prolonging the life of a container while being selectively sealable to allow access to the interior of the container and the contents stored therein while also mitigating spillage of the contents and having an appropriate look and feel would be desirable.

SUMMARY OF THE INVENTION

The following presents a simplified summary of the invention in order to provide a basic understanding of some aspects of the invention. This summary is not an extensive overview of the invention. It is intended neither to identify key or critical elements of the invention nor to delineate the scope of the invention. Rather, its primary purpose is merely to present one or more concepts of the invention in a simplified form as a prelude to the more detailed description that is presented later.

The present invention pertains to a reversible sack that is suitable for use as a container liner. The sack is selectively sealable and in one example can be opened and/or closed to varying degrees. More particularly, the sack has an open end and one or more mechanisms associated therewith that facilitate opening and/or closing the open end of the sack. In one example, the sack also includes a mechanism that facilitates maintaining the open end of the sack in any of the various degrees of opened and/or closed conditions. The sack functions the same regardless of whether it is in a reversed or un-reversed configuration. The reversibility of the sack provides for added versatility and allows a user to employ the sack in an un-reversed and reversed configuration as may be desired and appropriate given particular settings, surroundings, times, seasons, etc.

According to one or more aspects of the present invention, a reversible sack suitable for use as a liner in a container is disclosed. The sack includes a body having an open end and a length of material located within a channel formed near the open end. A passageway extends substantially perpendicularly through material within which the channel is formed. Additionally, a chordstop is operatively coupled to a portion of the length of material extending out from the channel through the passageway. The length of material facilitates selective closing and/or opening of the open end of the sack to varying degrees by cinching the length of material and feeding slack length of material into the channel, respectively. The chordstop facilitates maintaining the open end of the sack in the variety of different opened and/or closed conditions. The chordstop is dimensioned relative to the passageway so as to pass through the passageway in one or more orientations while not being able to pass through the passageway in one or more other orientations. Passage of the chordstop through the passageway allows the chordstop to be selectively located on an inside of the sack or an outside of the sack as desired regardless of whether or not the sack is in a reversed or un-reversed configuration.

According to one or more other aspects of the present invention, a sack suitable for use as a liner in a container includes a body having an open end. The sack also includes first fastening means for fastening two drawn together substantially opposing portions of the body near the open end of the sack and second fastening means for fastening two substantially opposing portions of the body near the open end of the sack over the drawn together portions of the sack.

In accordance with one or more other aspects of the present invention, a reversible sack has a pattern on an inside and a pattern on an outside, where the inside and outside patterns are reversed with respect to one another when the sack is reversed. The sack includes means for selectively opening and/or closing an open end of the sack to varying degrees and maintaining the sack in these various opened and/or closed conditions regardless of whether the sack is in an un-reversed or reversed configuration.

To the accomplishment of the foregoing and related ends, the following description and annexed drawings set forth in detail certain illustrative aspects and implementations of the invention. These are indicative of but a few of the various ways in which one or more aspects of the present invention may be employed. Other aspects, advantages and novel features of the invention will become apparent from the following detailed description of the invention when considered in conjunction with the annexed drawings.

DETAILED DESCRIPTION OF THE INVENTION

Figure 1:
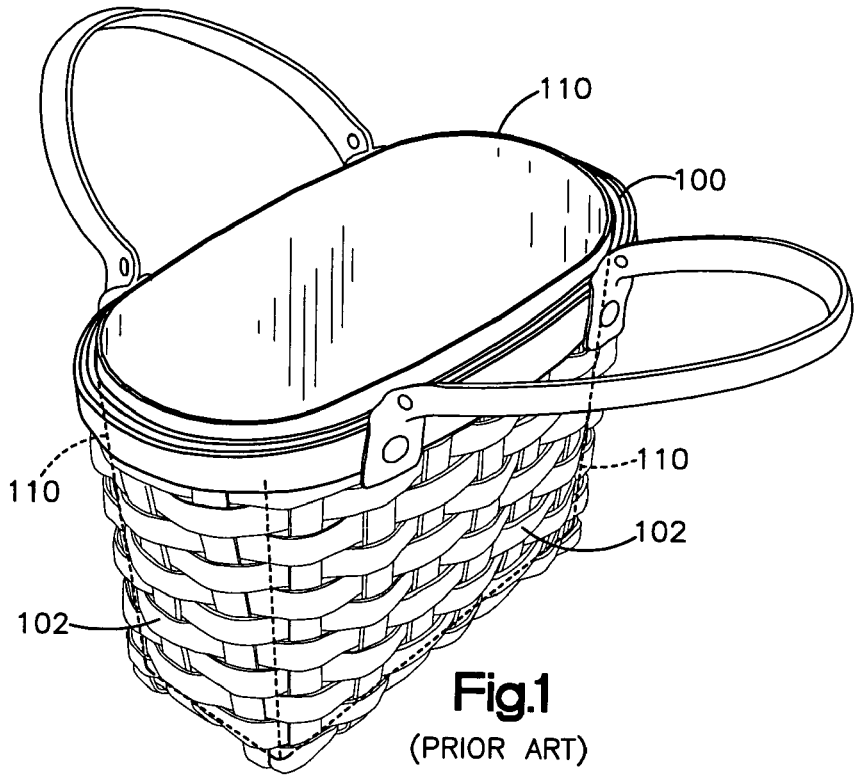
Fig.1 (PRIOR ART)
FIG. 1 is a perspective view of a basket type container having a conventional rigid liner situated therein.
Figure 2:
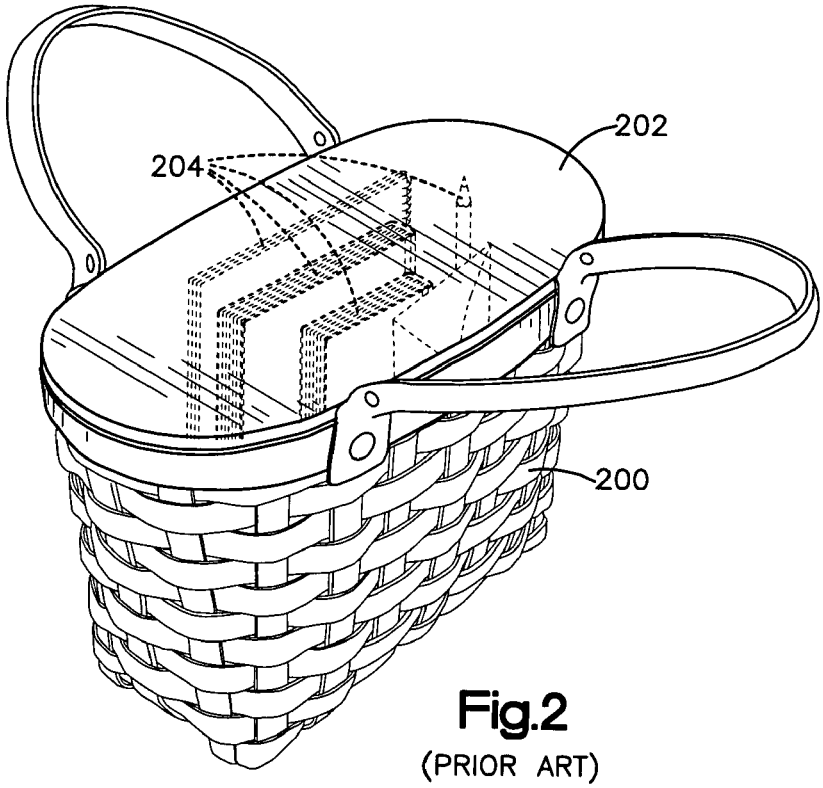
Fig.2 (PRIOR ART)
FIG. 2 is a perspective view of a basket type container having a conventional rigid liner situated therein and a conventional lid or cover situated thereon.

One or more aspects of the present invention are described with reference to the drawings, wherein like reference numerals are generally utilized to refer to like elements throughout, and wherein the various structures and/or features are not necessarily drawn to scale. In the following description, for purposes of explanation, numerous specific details are set forth in order to provide a thorough understanding of one or more aspects of the present invention. It may be evident, however, to one skilled in the art that one or more aspects of the present invention may be practiced with a lesser degree of these specific details. In other instances, well-known structures and devices may be shown in block diagram form in order to facilitate describing one or more aspects of the present invention.

The present invention pertains to a reversible sack that is suitable for use as a container liner. The sack is selectively sealable and in one example can be opened and/or closed to varying degrees. More particularly, the sack has an open end and one or more mechanisms associated therewith that facilitate opening and/or closing the open end of the sack. In one example, the sack also includes a mechanism that facilitates maintaining the open end of the sack in any of the various degrees of opened and/or closed conditions. The sack functions the same regardless of whether it is in a reversed or un-reversed configuration. The reversibility of the sack provides for added versatility and allows a user to employ the sack in an un-reversed and reversed configuration as may be desired and appropriate given particular settings, surroundings, times, seasons, etc.

Figure 3:
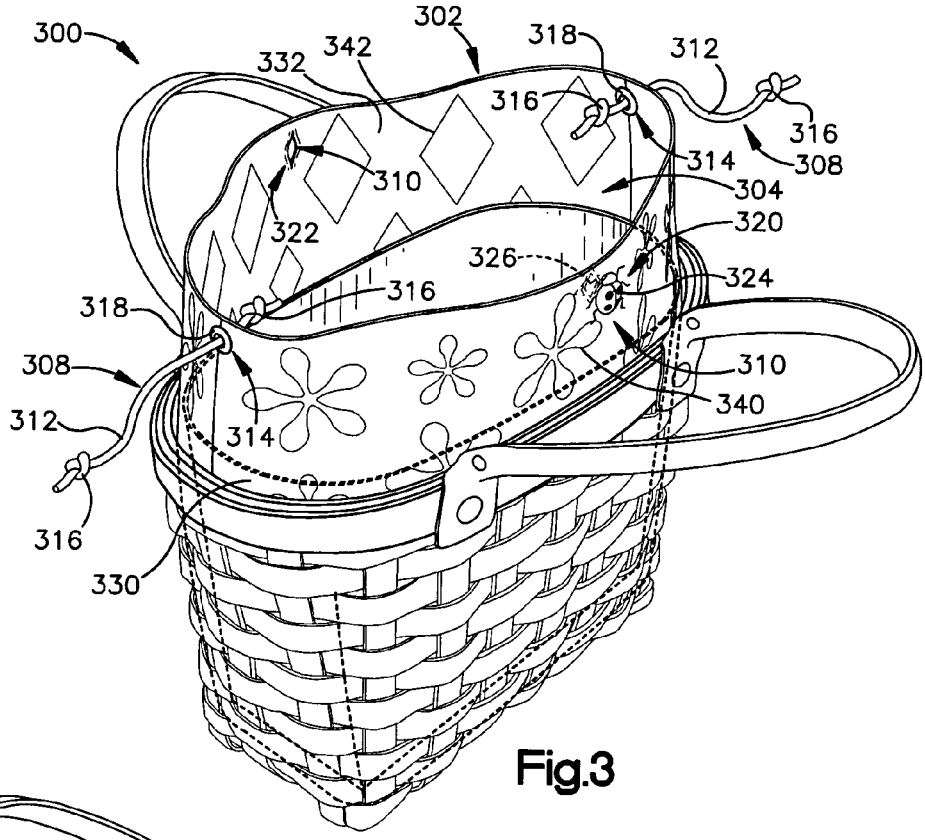
FIG. 3 is a perspective view of a sack suitable for use as a container liner according to one or more aspects of the present invention.

Turning to FIG. 3, a perspective view of a sack 300 suitable for use as a container liner according to one or more aspects of the present invention is illustrated. The sack 300 includes a body 302 with an open end 304. The sack 300 also has fastening means for closing and fastening the open end 304. In particular, in the illustrated example, the sack includes first fastening means 308 and second fastening means 310. More particularly, in the illustrated example, the first fastening means 308 includes lengths of material (e.g., of string, chord, rope, twine, etc.) 312 threaded through holes 314 formed within the body 302 near the open end 304 of the sack 300. In the illustrated example, the lengths of material 312 are located substantially opposite one another across the open end 304 of the sack 300.

The lengths of material 312 are knotted 316 and/or otherwise configured or outfitted at respective ends so that they can't be pulled through the holes 314. The lengths of material 312 may, however, slide within the holes 314 to facilitate interlocking (e.g., by being tied in a bow) to securely fasten at least a portion of the (formerly) open end 304 of the sack 300. The holes 314 may, for example, include grommets 318 and/or other low friction type items that promote the ease with which the lengths of material 312 can slide therein. The ability of the lengths of material 312 to slide within the holes 314, but not be entirely pulled there-through, allows substantially opposing portions of the open end 304 of the sack 300 to be fastened together regardless of whether the sack 300 is in a reversed or un-reversed configuration.

The second fastening means 310 in the illustrated example includes one or more buttons 320 and one or more button holes 322 located near the open end 304 of the sack 300 substantially opposite one another across the open end 304 of the sack 300. To facilitate reversibility of the sack 300 and fastening thereof regardless of whether the sack 300 is in a reversed or un-reversed configuration, two buttons 324, 326 are included in the illustrated example. One button 324 (e.g., a ladybug in the illustrated example) is located on an outside 330 of the sack 300 to facilitate closing the open end 304 of the sack 300 when the sack 300 is in an un-reversed configuration, and the other button 326 is located on an inside 332 of the sack 300 to facilitate closing the open end 304 of the sack 300 when the sack 300 is in a reversed configuration.

It will be appreciated, however, that any suitable button and button hole arrangement is contemplated as falling within the scope of the present invention. By way of example, respective button holes may exist to accommodate corresponding buttons, rather than a single hole accommodating different buttons. Similarly, it will be appreciated that while the holes 316 and lengths of material 212 are positioned at substantially opposite locations across the open end 304 of the sack 300, these items can be located at any desired positions so as to close and fasten the open end 304 of the sack 300 in any suitable or desired manner.

It will also be appreciated that while two corresponding holes 316 and lengths of material 312 are depicted in the illustrated example, any number of these items are contemplated as falling within the scope of the present invention. The same is true for the buttons and button holes with regard to, at least, location and number. Further, it will be appreciated that while sacks or liners illustrated herein, such as that depicted in FIG. 3, appear to have essentially four quadrants with some type of fastening means respectively located therein, this configuration is merely set forth and displayed for demonstrative purposes, and is not to be construed in a limiting sense.

Moreover, sacks and/or liners according to one or more aspects of the present invention can have any suitable configuration and, as alluded to above, any suitable number of fastening means and/or mechanisms arranged in any suitable manner. Also, fastening means as used herein is intended to include any suitable devices, items, arrangement, etc. as well as their equivalents, such as buttons, snaps, lengths of material (e.g., string, chord, rope, twine), glue, tape or other adhesive type/based items, magnets, zippers, hook and latch (e.g., Velcro) arrangements, clasps, clips, elastic type bands, screws, bolts, post and bail systems, belts, buckles, staples, pins, padlocks, hasps, clamps, couplings, dowels, keepers, lugs, seams, rivets, belts, etc.

In the illustrated example, the first fastening means 308 thus serves to fold-in and fasten together opposing portions of the body 302 near the open end 304 of the sack 300. The second fastening means 310 serves to similarly fold-in and fasten opposing portions of the body 302. It will be appreciated that the portions of the body 302 acted upon by the second fastening means 310 are generally, but need not always be, folded-in and fastened over the portions of the body 302 secured in place by the first fastening means 308. In this manner, the open end 304 is closed having a neat and clean appearance securing the contents therein.

It will be appreciated that the reversibility of the sack can prolong the life of the sack and can also afford versatility and provide cost savings to a user of the sack 300. In particular, the outside 330 and inside 332 of the sack 300 may have respective patterns formed thereon that facilitate different uses. The outside 330 of the sack 300 can, for example, have a first pattern 340 while the inside 332 of the sack 300 can, for example, include a second pattern 342. Buttons 324, 326 can similarly be of a corresponding pattern. By way of example, should the sack 300 be used as a liner for a basket type container or purse such as that depicted in FIG. 1, the respective sides 330, 332 may have seasonal patterns formed thereon and the buttons can be of corresponding designs.

The first pattern 340 may, for example, include flowers or the like corresponding to a spring usage, while the second pattern 342 may, for example, include leaves or the like corresponding to an autumn usage. Button 324 can thus take the form of a flower or spring-time flower-bud while button 326 can take the shape of an autumn fallen leaf. By way of further example, one of the sides can have a lighter pattern for daytime use, while the other side can have a darker pattern for evening use, etc. and buttons 324, 326 can be of complementary designs. The sack 300 would thus allow a single basket type container or purse to be utilized in multiple settings and/or time frames. This provides versatility and cost effectiveness to a user as the same container can be utilized on multiple occasions.

It will be appreciated that any such convenient mechanism for expanding the versatility of the bag 300 is contemplated as falling within the scope of the present invention. For instance, the sack 300 can be utilized to store items and the patterns may correspond to different labeling on the inside 332 and outside 330 of the sack. In this manner, the sack 300 can be configured so that the labeling corresponding to the stored contents is on the outside 330 of the sack 300 to easily identify what is stored within the sack 300.

Additionally, it will be appreciated that the sack 300 can be dimensioned to (somewhat snugly) accommodate a relatively rigid (e.g., plastic) liner, such as that illustrated in FIG. 1. As such, the contents of the container can be situated within the rigid liner, and the sack 300 and the rigid liner can be easily removed from the container in a single action with the contents remaining therein un-disturbed. The sack 300 can then be slipped off of the rigid liner and turned inside-out or vice-versa as may be desired.

The rigid (e.g., plastic) liner can then be placed back into the re-configured sack 300 and the combined sack 300 and rigid liner can be set back into the basket type container in a single action (e.g., with the lengths of material 312 providing a mechanism for assisting with lifting and lowering the sack). In this manner, the sack 300 can be reconfigured without disturbing the contents of the container. Also, the rigid liner may be contoured to the shape of the container and may thereby provide support to the sack 300 such that the sack 300 is at least somewhat filled out and held up to conform to the shape of the container. The sack 300 may, in turn, soften some of the harsh look and feel of the rigid liner.

Figure 4:
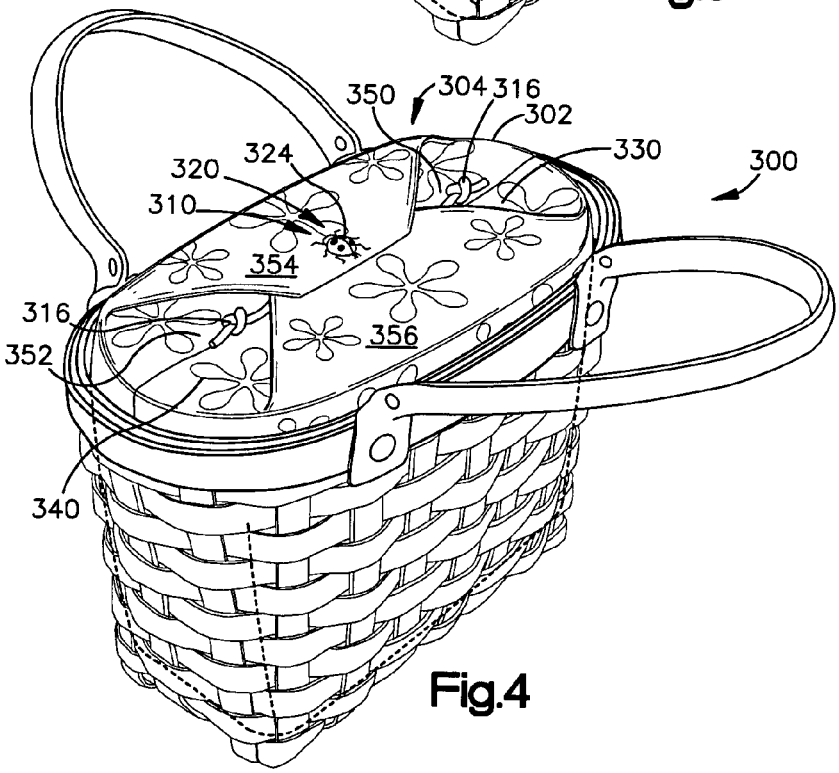
FIG. 4 is a perspective view of a sack such as that depicted in FIG. 3, but with an open end in a closed condition.

FIG. 4 is a perspective view of the sack 300 with the open end 304 at least partially closed. More particularly, portions 350, 352 of the open end 304 are fastened together by the lengths of material 312 (e.g., that are tied together in a bow). Other portions 354, 356 of the open end 304 can then be folded and fastened there-over via the button 320 and button hole 322 of the second fastening means 310, respectively.

Figure 5:
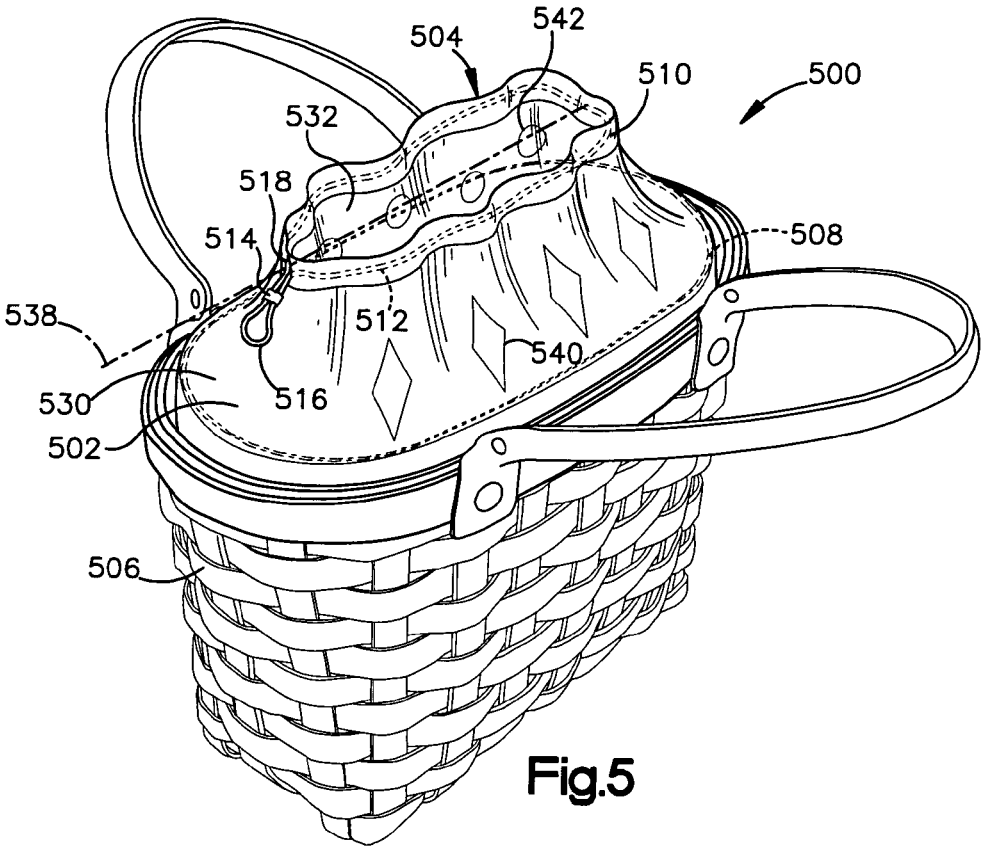
FIG. 5 is a perspective view of another implementation of a sack suitable for use as a container liner according to one or more aspects of the present invention.

Turning to FIG. 5, another sack 500 suitable for use as a container liner in accordance with one or more aspects of the present invention is illustrated in perspective view. As with the aforementioned implementation, the sack 500 includes a body 502 having an open end 504. In the illustrated example, the sack 500 is somewhat recessed within a basket type container 506 essentially made up of woven together pieces of (wooden) material. As such, the sack 500 can be said to be serving as a soft liner for the basket type container 506.

A somewhat more rigid (e.g., plastic) liner 508 is also recessed within the sack 500 in the illustrated example. As such, the sack 500 may be supported or propped-up to some degree within the container 506 by the liner 508 which may be formed so as to contour to the interior of the container 506. It is to be appreciated that the sack 500 may also be fabricated so as to be somewhat contoured to the interior of the container 506. To that end, it is to be appreciated that the sack 500 (as well as sack 300 and any other sacks described herein according to one or more aspects of the present invention) can be fashioned to have any suitable dimension (s) and/or configuration(s).

The sack 500 has a channel 510 formed therein near the open end 504, and a length of material (e.g., of string, chord, rope, twine, etc.) 512 resides within the channel 510. In the illustrated example, the channel 510 and the length of material 512 residing therein extend around the entire perimeter of the open end 504. However, it will be appreciated that for purposes of the present invention, either or both of these items may exist to any degree around the open end 504.

The length of material 512 has a chordstop 514 operatively associated therewith. More particularly, the chordstop 514 is operatively coupled to a portion 516 of the length of material 512 extending out from the channel 510 through a passageway 518 formed within the body 502, and more particularly through material within which the channel 510 is formed. The passageway 518 is thus an aperture that passes from an outside 530 of the sack 500 to an inside 532 of the sack 500 (or vice versa) and through the channel 510.

It will be appreciated that the passageway 518 may also be utilized to feed the length of material 512 into the channel 510 and around the open end 504 of the sack 500. It will be further appreciated that the passageway 518 may be configured in such a manner so as to pierce the channel 510. In this manner, a line 538 passing through the channel 510 may be substantially perpendicular to a plane within which the immediately surrounding channel 510 lies. Stated another way, a line 538 passing through the channel 510 may be substantially perpendicular to a plane within which the material within which the immediately surrounding channel is defined lies.

It will be appreciated that the length of material 510 facilitates selective closure and/or opening of the open end 504 of the sack 500. More particularly, the open end 504 of the sack 500 can be selectively closed to varying degrees by cinching or drawing together some of the length of material 512. The drawn-together or taken-up length of material 512 can be pulled out through the passageway 518, for example. Similarly, the open end 504 of the sack 500 can be selectively opened or enlarged by feeding some length of material 512 into the channel 510. Slack length of material 512 can, for example, be fed into the channel through the passageway 518.

The chordstop 514 facilitates maintaining the open end 504 of the sack 500 in the various degrees of opened and/or closed conditions. The chordstop 514 may, for example, include a spring loaded mechanism or the like that frictionally or otherwise engages the portion 516 of the length of material 512 extending out through the passageway 518. Accordingly, the chordstop "grabs" the that portion 516 of material 512 and prevents it from passing through the chordstop. The chordstop 514 may also have a spring or other release type mechanism that allows the length of material 512 to pass there-through when actuated. In this manner, the length of material 512 can be selectively drawn through the chordstop 514 in closing the open end 504 and released through the chordstop 514 when opening the open end 504.

In accordance with one or more aspects of the present invention the chordstop 514 is dimensioned relative to the passageway 518 such that the chordstop 514 can pass through the passageway 518 in one or more orientations, but can not pass through the passageway 518 in one or more other orientations. In this manner, the open end 504 of the sack 500 can be maintained in a closed (or opened) condition by having a certain amount of material 512 extend through the passageway and through the chordstop 514 while forcing the chordstop 514 toward the passageway 518.

As with the aforementioned implementation, the outside 530 of the sack 500 and the inside 532 of the sack 500 may have respective patterns formed thereon to accommodate reversibility and facilitate different uses. The outside 530 of the sack 500 can, for example, have a first pattern 540 while the inside 532 of the sack 500 can, for example, include a second pattern 542, where the first 540 and second 542 patterns can correspond to and/or be suitable for different uses and/or situations, depending upon times of day, seasonal considerations, surroundings, etc.

The relative dimensioning of the chordstop 514 and the passageway 518 facilitate reversibility by allowing the chordstop to be on the inside or outside of the sack 500 as may be desired, regardless of the whether the sack 500 is in a reversed or un-reversed condition. By way of example, and as can be better appreciated via the enlarged depiction of the chordstop 514 and passageway 518 illustrated in FIG. 6, the passageway 518 may have a height 560 slightly greater that a height 562 of the chordstop 514, but a width 564 that is substantially narrower than a width 566 of the chordstop 514.

Figure 6:
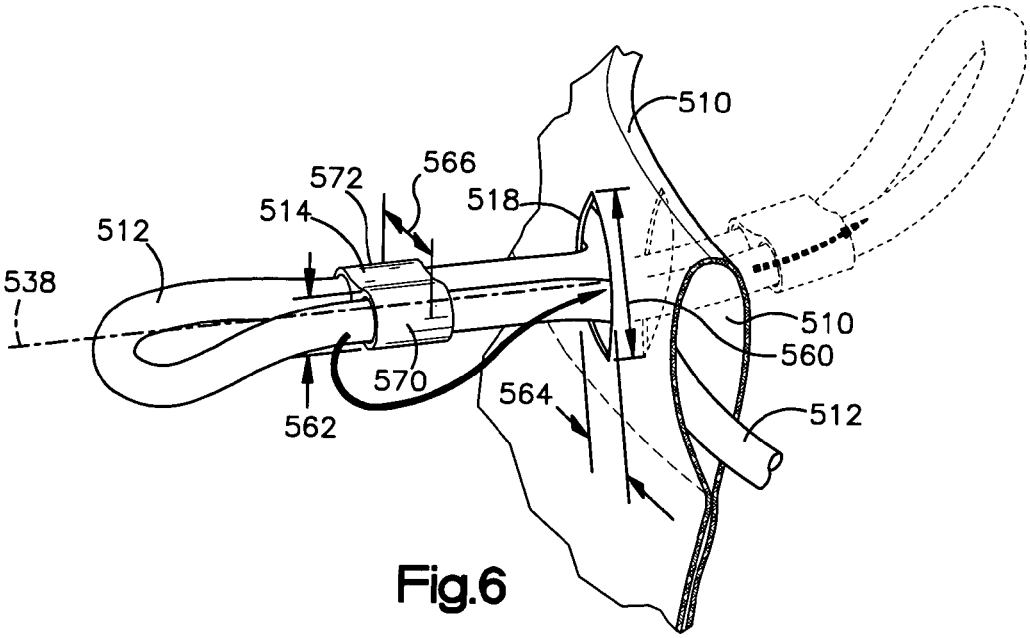
FIG. 6 is an enlarged view of a chord and chordstop having exemplary dimensions relative to a passageway in accordance with one or more aspects of the present invention.

The chordstop 514 would, accordingly, be prohibited from passing through the passageway 518 in the relative orientation depicted in FIG. 6. In this orientation the chordstop 514 would, however, be effective to maintain the open end 504 of the sack 500 in a selectively opened and/or closed position. The chordstop 514 would be able to pass through the passageway 518 if the chordstop 518 was oriented relative to the passageway 518 such that one end 570 of the chordstop 514 could be fed through the passageway 518 first, followed by the rest of the chordstop 514, with the other end of the chordstop 572 finally passing through the passageway 518. It is to be appreciated, however, that the present invention is not meant to be limited by the illustrated example, but that any suitable arrangement is intended to fall within the scope of the present invention.

Additionally, as mentioned above the passageway 518 can be formed within the sack 500 such that the line 538 passing through the passageway 518 may be substantially perpendicular to a plane within which the immediately surrounding channel 510 and/or material defining the channel lies. In the illustrated example, the line 538 may also be substantially perpendicular to a plane within which the main body of the chordstop 514 lies.

Figure 7:
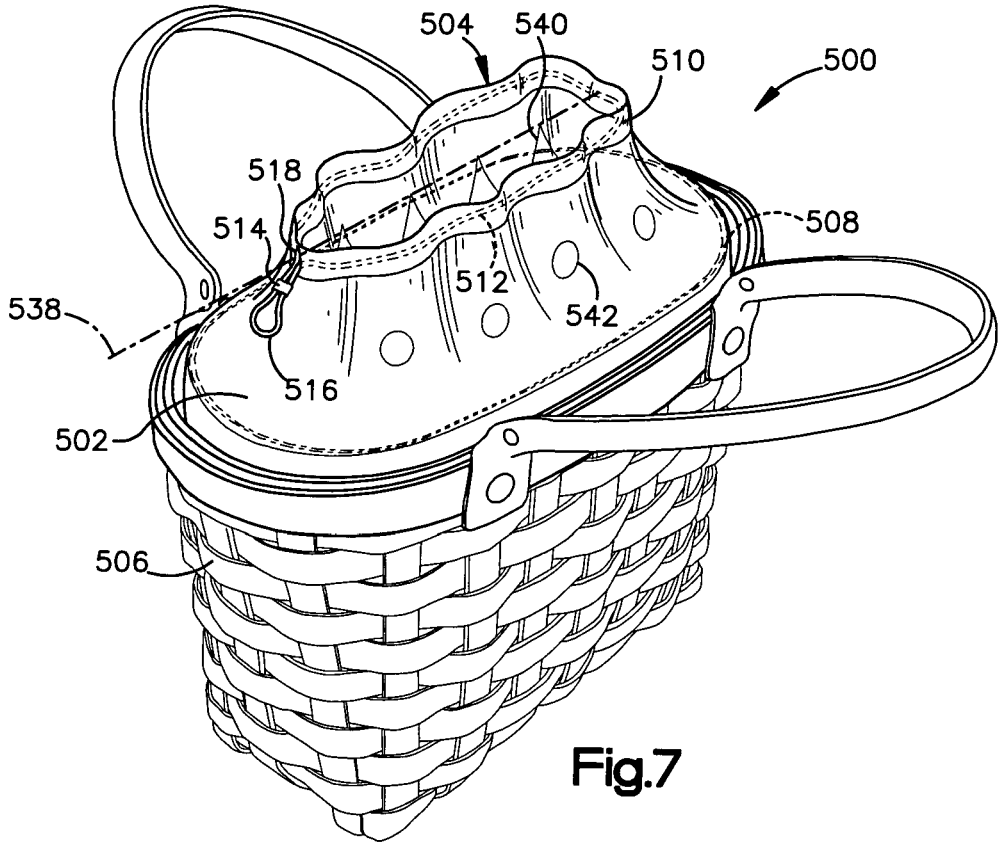
FIG. 7 is a perspective view of a sack such as that depicted in FIG. 5, but in a reversed configuration.

FIG. 7 is a perspective view of the sack 500 situated within a container type basket similar to the illustration depicted in FIG. 5. However, the sack 500 is in a reversed condition such that the former outside of the sack is now on the inside and the former inside is now on the outside. Accordingly, the first pattern 540 is now on the inside of the sack 500 and the second pattern 542 is now on the outside of the sack 500. The sack 500 is illustrated in a partially closed condition such that items (not shown) located therein (e.g., within the somewhat rigid liner 508) would not easily fall out. Additionally, the chordstop 514 is once again situated on the outside of the sack 500. As such, the chordstop 514 has been oriented so as to pass through the passageway 518 and then re-oriented so as to not pass back through the passageway 518.

Figure 8:
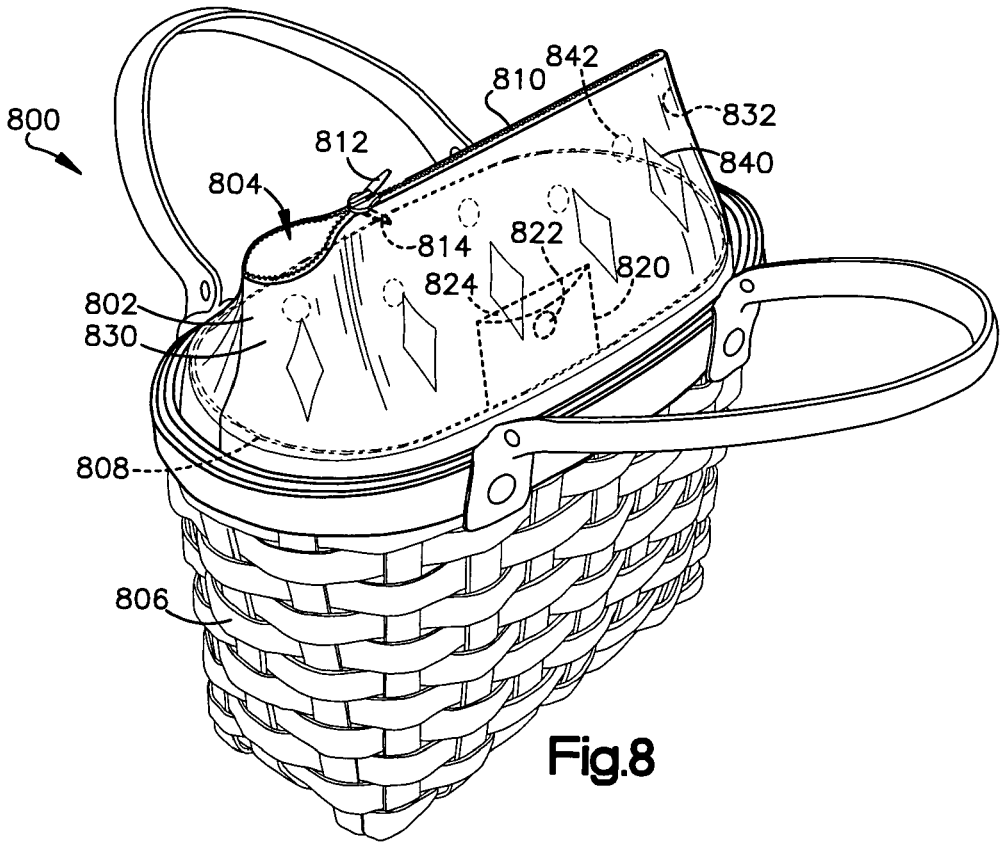
FIG. 8 is a perspective view of another implementation of a sack suitable for use as a container liner according to one or more aspects of the present invention.

Turning to FIG. 8, a perspective view of yet another implementation of a sack 800 suitable for use as a liner for a container is illustrated in accordance with one or more aspects of the present invention. As before, the sack 800 includes a body 802 having an open end 804. The sack 800 is illustrated within a basket type container 806 and has a somewhat rigid (e.g., plastic) liner 808 situated therein.

The sack 800 has an outside 830 and an inside 832, and the sides can have respective patterns formed thereon to accommodate reversibility and a variety of different uses. The outside 830 of the sack 800 can, for example, have a first pattern 840 formed thereon while the inside 832 of the sack 800 can, for example, have a second pattern 842 formed thereon, where the first 840 and second 842 patterns can correspond to and/or be suitable for different uses and/or situations, depending upon times of day, seasonal considerations, surroundings, etc.

To further facilitate reversibility, the sack 800 also includes fastening means in the form of a reversible zipper 810 that has a pull tab 812 on the outside 830 of the sack 800 and a pull tab 814 on the inside 832 of the sack 800. Thus, the open end 804 of the sack 800 can be selectively sealed to varying degrees regardless of whether the sack 800 is in an un-reversed or reversed condition.

In the illustrated example, the sack 800 also has a pocket 820 formed therein. The pocket 820 has fastening means 822 that in the illustrated example includes a button or snap to securely fasten a lid 824 of the pocket 820. The pocket 820 thus becomes an external pocket when the sack 800 is reversed. It will be appreciated that any of the implementations disclosed herein may have any number of such or different type pockets having the same, different or no such fastening means.

Figure 9:
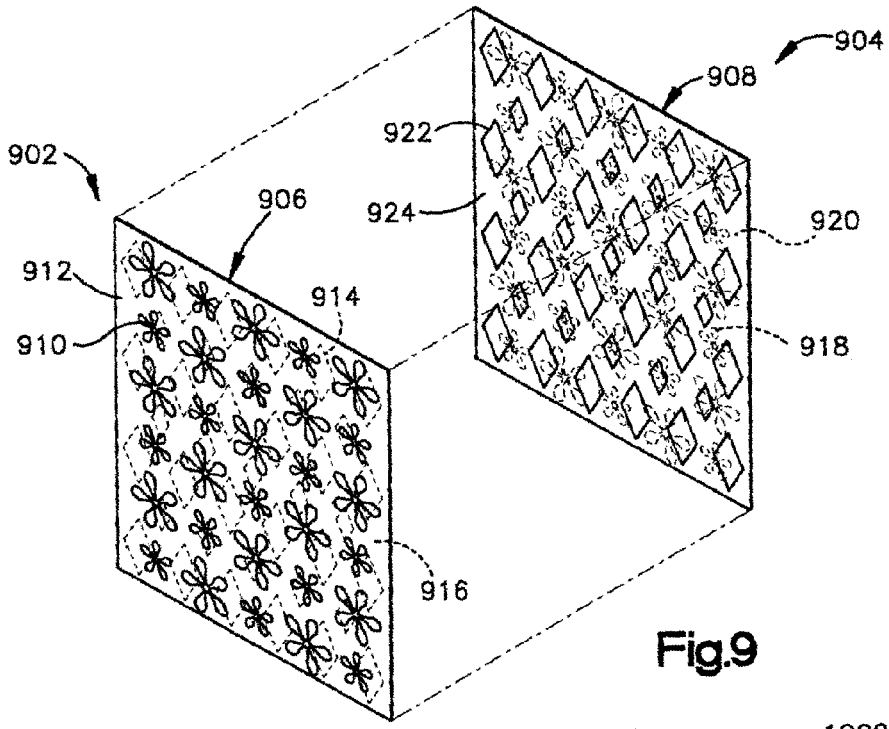
FIG. 9 is a perspective view of sheets of material out of which a sack suitable for use as a container liner in accordance with one or more aspects of the present invention may be fashioned.

Turning to FIG. 9, one or more of the implementations described herein may be fashioned out of two sheets of material 902, 904 formed into substantially square configurations. The sheets of material 902, 904 can, for example, be stitched together around their respective perimeters to readily form a sack that may be suitable for use as a container liner. The sheets 902, 904 would, of course, not be joined together at upper portions 906, 908 so as to define an open end within the sack.

A channel suitable to accommodate a length of material can readily be formed near the open end of the sack by merely turning down and fastening (e.g., stitching) some material near the upper portions 906, 908 of the sheets. It will be appreciated that a length of material can be placed within the channel created by the turned down material prior to fastening the same. In this manner, time and expense may be saved by not having to manually route the length of material through the channel after the fact.

One or more separate pieces of material (not shown) can alternatively be fastened (e.g., stitched) to the upper portions 906, 908 of the sheets 902, 904 to define such a channel (and a length of material can, again, be placed with the channel prior to fastening or sealing. Similarly, any suitable number and/or type of fastening means can be integrated into the upper portions 906, 908 of the sheets 902, 904 at any desired locations to facilitate selective opening and/or closing of the open end of the sack to varying degrees.

The sheets of material 902, 904 may have respective patterns formed thereon on either side to provide the aforementioned first pattern on the outside of the sack and second pattern on the inside of the sack. The first sheet of material 902 can, for example, have a first pattern 910 formed on a first side or its outside 912 and a second pattern 914 formed on a second side or its inside 916. Similarly, the second sheet of material 904 can have a first pattern 918 formed on a first side or its outside 920 and a second pattern 922 formed on a second side or its inside 924. Generally speaking, the first patterns 910, 918 would be the same and the second patterns 914, 922 would likewise be the same so that the sack has a uniform pattern on the inside and outside regardless of whether the sack is in an un-reversed or reversed configuration.

It will be appreciated that raw material out of which the sheets 902, 904 are derived (e.g., cut) may not have patterns on both sides. As such, a sack made out of such raw materials may not be reversible, or, if it is reversibly, may have a blank or non-descript pattern on either its inside or outside, depending on whether it is in a reversed or unreversed configuration. Accordingly, the sheets of material 902, 904 may themselves be made out of multiple (e.g., two) sheets of raw material having respective patterns a side.

Figure 10:
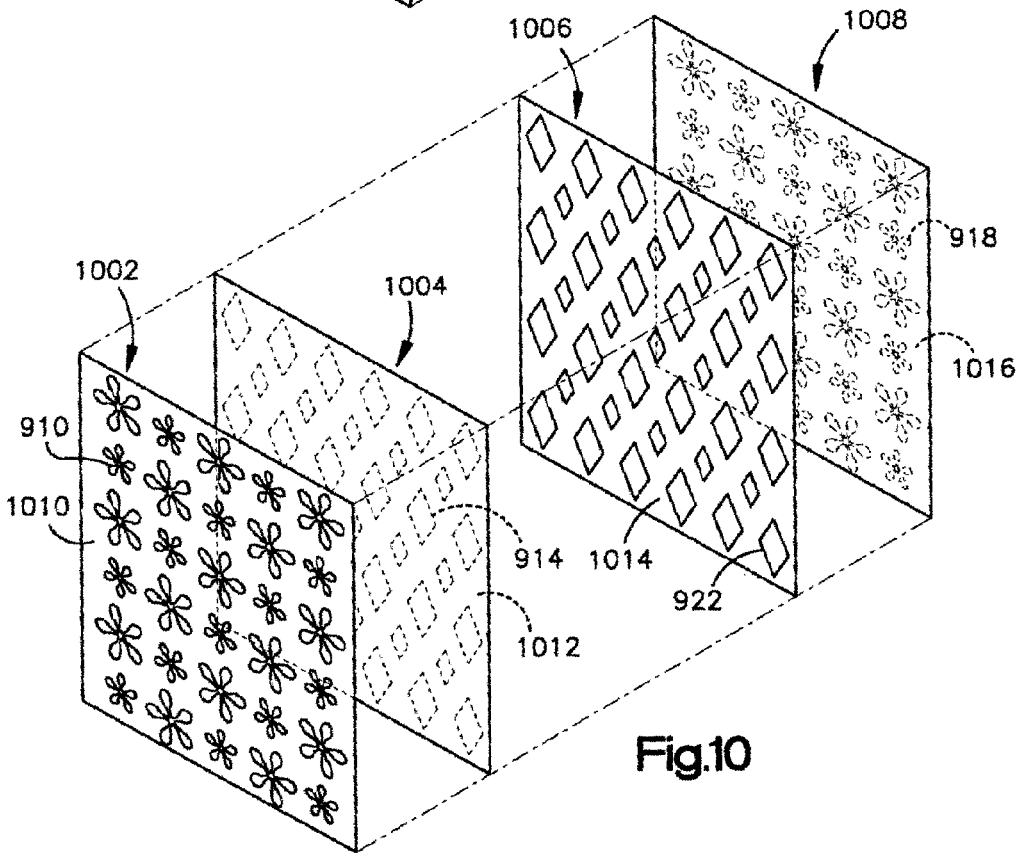
FIG. 10 is a perspective view of multiple sheets of one or more raw materials out of which the sheets depicted in FIG. 9 may be formed according to one or more aspects of the present invention.

By way of example, respective sheets of raw materials are illustrated in FIG. 10. Material 902 of FIG. 9 may, for example, be made up of two sheets of raw material 1002, 1004 that can be brought and fastened (e.g., stitched) together around (the entirety of) their perimeters. Similarly, material 904 of FIG. 9 may, for example, be made up of two sheets of raw material 1006, 1008 that can be brought and fastened (e.g., stitched) together around (the entirety of) their perimeters.

The first pattern 910 of the first sheet of material 902 in FIG. 9 can, for example, be defined within a first side 1010 of the first sheet of raw material 1002 illustrated in FIG. 10. The second pattern 914 of the first sheet of material 902 can be defined within a second side 1012 of the second sheet of raw material 1004. The first pattern 918 of the second sheet of material 904 can be defined within a second side 1016 of the fourth sheet of raw material 1008. The second pattern 922 of the second sheet of material 904 can similarly be defined within a first side 1014 of the third sheet of raw material 1006. It will be appreciated that any or all of the materials 902, 904, 1002, 1004, 1006, 1008 and thus some or all of any of the implementations described herein may be made up of any suitable fabrics, such as cotton, silk, wool, leather, vinyl, naugahyde, etc.

Accordingly, one or more aspects of the present invention provide for a convenient reversible sack suitable for use as a container liner. The sack can be selectively closed to varying degrees and fastened to securely maintain items therein. It is to be appreciated that although the sacks and/or liners are depicted herein in association with woven wooden basket type containers, sacks and/or liners according to one or more aspects of the present invention have application to any suitable number and types of containers.

Although the invention has been shown and described with respect to one or more implementations, equivalent alterations and modifications will occur to others skilled in the art based upon a reading and understanding of this specification and the annexed drawings. The invention includes all such modifications and alterations and is limited only by the scope of the following claims. In particular regard to the various functions performed by the above described components (assemblies, devices, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary implementations of the invention. In addition, while a particular feature of the invention may have been disclosed with respect to only one of several implementations, such feature may be combined with one or more other features of the other implementations as may be desired and advantageous for any given or particular application. Furthermore, to the extent that the terms "includes", "having", "has", "with", or variants thereof are used in either the detailed description or the claims, such terms are intended to be inclusive in a manner similar to the term "comprising."

What is claimed is:

1. A sack suitable for use as a liner in a container, comprising:

a body having an open end;

first fastening means for fastening first and second drawn together substantially opposing portions of the body near the open end of the sack, the first fastening means comprising:

a first length of material operatively associated with the first portion of the body near the open end of the sack; and a second length of material operatively associated with the second portion of the body near the open end of the sack, the first and second lengths of material being separate and distinct lengths of material discontinuous from one another; and second fastening means for fastening third and fourth drawn together substantially opposing portions of the body near the open end of the sack, the second fastening means comprising:

at least one button secured to an inside of the body of the sack;

at least one button secured to an outside of the body of the sack;

at least one button hole substantially opposite the at least one button secured to the inside of the body of the sack for fasteningly accommodating the at least one button secured to the inside of the body of the sack; and at least one button hole substantially opposite the at least one button secured to the outside of the body of the sack for fasteningly accommodating the at least one button secured to the outside of the body of the sack, where the outside of the body of the sack includes a first pattern and the inside of the body of the sack includes a second pattern, the at least one button secured to the outside of the body of the sack corresponding to the first pattern and the at least one button secured to the inside of the body of the sack corresponding to the second pattern.

2. The sack of claim 1, the first and second lengths of material configured to fasteningly engage one another at a location substantially centered over the end of the sack, regardless of whether the sack is in reversed or un-reversed configurations.

3. The sack of claim 2, wherein the first fastening means incorporates at least one grommet through which at least one of the first and second lengths of material can readily slide to facilitate operability of the first fastening means in reversed and un-reversed configurations.

4. The sack of claim 2, where the at least one button hole substantially opposite the at least one button secured to the inside of the body of the sack and the at least one button hole substantially opposite the at least one button secured to the outside of the body of the sack may or may not correspond to the same at least one button hole(s).

5. The sack of the claim 1, the first and second portions substantially orthogonal to the third and fourth portions.

6. The sack of claim 1, the at least one button secured to an inside of the body of the sack and the at least one button secured to an outside of the body of the sack engaging corresponding button hole(s) at a location substantially centered over the end of the sack, regardless of whether the sack is in reversed or un-reversed configurations.

7. The sack of claim 2, the at least one button secured to an inside of the body of the sack and the at least one button secured to an outside of the body of the sack engaging corresponding button hole(s) at a location substantially centered over the end of the sack, regardless of whether the sack is in reversed or un-reversed configurations.

8. A sack suitable for use as a liner in a container, comprising:

a body having an open end;

first fastening means for fastening first and second drawn together substantially opposing portions of the body near the open end of the sack, the first fastening means comprising:

a first length of material operatively associated with the first portion of the body near the open end of the sack; and a second length of material operatively associated with the second portion of the body near the open end of the sack, the first and second lengths of material being separate and distinct lengths of material discontinuous from one another; and second fastening means for fastening third and fourth drawn together substantially opposing portions of the body near the open end of the sack.

9. The sack of claim 8, the first and second lengths of material configured to fasteningly engage one another at a location substantially centered over the end of the sack, regardless of whether the sack is in reversed or un-reversed configurations.

10. The sack of claim 8, the second fastening means comprising:

a first component operatively associated with the third portion of the body near the open end of the sack; and a second component operatively associated with the fourth portion of the body near the open end of the sack, the first and second components configured to fasteningly engage one another at a location substantially centered over the end of the sack, regardless of whether the sack is in reversed or un-reversed configurations.

11. The sack of claim 9, the second fastening means comprising:

a first component operatively associated with the third portion of the body near the open end of the sack; and a second component operatively associated with the fourth portion of the body near the open end of the sack, the first and second components configured to fasteningly engage one another at a location substantially centered over the end of the sack, regardless of whether the sack is in reversed or un-reversed configurations.

12. The sack of claim 10, at least one of the first and second components comprising at least one of buttons, snaps, lengths of material, glue, tape or other adhesive type/based items, magnets, zippers, hook and latch arrangements, clasps, clips, elastic type bands, screws, bolts, post and bail systems, belts, buckles, staples, pins, padlocks, hasps, clamps, couplings, dowels, keepers, lugs, seams, rivets and belts.

13. The sack of claim 11, at least one of the first and second components comprising at least one of buttons, snaps, lengths of material, glue, tape or other adhesive type/based items, magnets, zippers, hook and latch arrangements, clasps, clips, elastic type bands, screws, bolts, post and bail systems, belts, buckles, staples, pins, padlocks, hasps, clamps, couplings, dowels, keepers, lugs, seams, rivets and belts.

14. The sack of claim 10, the first component comprising:

at least one button secured to an inside of the body of the sack; and at least one button secured to an outside of the body of the sack, the second component comprising:

at least one button hole substantially opposite the at least one button secured to the inside of the body of the sack for fasteningly accommodating the at least one button secured to the inside of the body of the sack; and at least one button hole substantially opposite the at least one button secured to the outside of the body of the sack for fasteningly accommodating the at least one button secured to the outside of the body of the sack, the at least one button hole substantially opposite the at least one button secured to the inside of the body of the sack and the at least one button hole substantially opposite the at least one button secured to the outside of the body of the sack may or may not correspond to the same at least one button hole(s).

15. The sack of claim 14, the at least one button secured to an inside of the body of the sack and the at least one button secured to an outside of the body of the sack engaging corresponding button hole(s) at a location substantially centered over the end of the sack, regardless of whether the sack is in reversed or un-reversed configurations.

16. The sack of claim 15, the outside of the body of the sack including a first pattern and the inside of the body of the sack including a second pattern, the at least one button secured to the outside of the body of the sack corresponding to the first pattern and the at least one button secured to the inside of the body of the sack corresponding to the second pattern.

17. The sack of claim 11, the first component comprising:

at least one button secured to an inside of the body of the sack; and at least one button secured to an outside of the body of the sack, the second component comprising:

at least one button hole substantially opposite the at least one button secured to the inside of the body of the sack for fasteningly accommodating the at least one button secured to the inside of the body of the sack; and at least one button hole substantially opposite the at least one button secured to the outside of the body of the sack for fasteningly accommodating the at least one button secured to the outside of the body of the sack, the at least one button hole substantially opposite the at least one button secured to the inside of the body of the sack and the at least one button hole substantially opposite the at least one button secured to the outside of the body of the sack may or may not correspond to the same at least one button hole(s).

18. The sack of claim 17, the at least one button secured to an inside of the body of the sack and the at least one button secured to an outside of the body of the sack engaging corresponding button hole(s) at a location substantially centered over the end of the sack, regardless of whether the sack is in reversed or un-reversed configurations.

19. The sack of claim 18, the outside of the body of the sack including a first pattern and the inside of the body of the sack including a second pattern, the at least one button secured to the outside of the body of the sack corresponding to the first pattern and the at least one button secured to the inside of the body of the sack corresponding to the second pattern.

* * * * *